US006109668A

United States Patent [19]

Demarco

[11] Patent Number: 6,109,668

[45] Date of Patent: Aug. 29, 2000

[54] WINDOW LOCK

[76] Inventor: Giuseppe Demarco, 185 Trowers Road., Units 7 & 8, Woodbridge, Ontario, Canada, L4L 5Z5

[21] Appl. No.: 09/247,319

[22] Filed: Feb. 10, 1999

[30] Foreign Application Priority Data

Feb. 27, 1998 [CA] Canada ..... 2230781

[51] Int. Cl.[7] ..... E05C 1/06

[52] U.S. Cl. ..... 292/161; 292/40; 292/143; 292/DIG. 20

[58] Field of Search ..... 292/158, 159, 292/161, 157, 139, 140, 143, DIG. 20, 36, 40, DIG. 33, 165–167, 169, 173, 34

[56] References Cited

U.S. PATENT DOCUMENTS

| | | | |
|---|---|---|---|
| 1,116,617 | 11/1914 | Page . | |
| 1,808,458 | 6/1931 | Flynn . | |
| 2,114,645 | 4/1938 | Van Benschoten . | |
| 2,721,750 | 10/1955 | Rudis et al. . | |
| 4,025,096 | 5/1977 | Geer . | |
| 4,182,144 | 1/1980 | Leivenson et al. . | |
| 4,991,886 | 2/1991 | Nolte et al. . | |
| 5,318,333 | 6/1994 | Dreifert | 292/36 X |
| 5,370,428 | 12/1994 | Dreifert | 292/161 |
| 5,813,710 | 9/1998 | Anderson | 292/161 X |
| 5,927,767 | 7/1999 | Smith et al. | 292/158 |

FOREIGN PATENT DOCUMENTS

| | | | |
|---|---|---|---|
| 1269120 | 5/1990 | Canada . | |
| 2050040 | 2/1997 | Canada . | |
| 2184552 | 9/1997 | Canada . | |
| 55430 | 10/1938 | Denmark | 292/159 |
| 2664932 | 1/1992 | France | 292/161 |
| 626330 | 2/1936 | Germany | 292/161 |
| 196 740 | 3/1958 | Germany | 292/161 |
| 204439 | 7/1959 | Germany | 292/161 |
| 208615 | 4/1960 | Germany | 292/161 |
| 60723 | 12/1912 | Switzerland | 292/161 |

*Primary Examiner*—B. Dayoan
*Assistant Examiner*—Clifford B Vaterlaus
*Attorney, Agent, or Firm*—Riches, McKenzie & Herbert

[57] ABSTRACT

A locking mechanism used to secure any number of window sashes closed against a window frame includes one or more keepers mounted to the window sash, and a tie bar having thereon a corresponding number of rollers, and an actuator assembly mounted to the window frame. The actuator assembly is configured to reciprocally move the tie bar and includes a housing and a handle lever and actuator arm pivotally mounted to the housing. A camming pin is coupled to the handle lever so that the rotation of the handle lever rotates the camming pin along an arc of a circle centered on the handle pivot. The pin extends into a slot formed in the actuator arm remote from an end coupled to the tie bar. As the camming pin moves along its arcuate path, its engagement with the slot urges the actuator arm in pivotal movement which in turn moves the tie bar.

20 Claims, 6 Drawing Sheets

WINDOW LOCK

SCOPE OF THE INVENTION

The present invention relates to a window lock, and more particularly, to a window lock used to secure a window sash closed against a frame, and which may be used in either a right hand or left hand configuration.

BACKGROUND OF THE INVENTION

Window locks consisting of a tie bar mounting two spaced apart cam members or rollers and which interact with keepers affixed to a window sash are well known. Typically, a handle actuator is coupled to the tie bar to drive it in reciprocal movement, so as to move the rollers into and out of engagement with an associated keeper. One such conventional window lock is disclosed in Canadian Patent No. 2,050,040, which issued Feb. 4, 1997, and has been assigned to Truth Hardware Corporation. Canadian Patent No. 2,050,040 discloses a window lock in which an L-shaped coupler link is coupled at its ends to the lock handle and tie bar.

The applicant has appreciated a disadvantage with conventional window sash locks in that their operating mechanisms are poorly suited to permit the locking of the actuator handle in either a locked or unlocked configuration.

A further disadvantage with conventional window locking hardware exists in that the locking mechanisms are often poorly suited for use in both right and left hand configurations. As such, the construction of conventional window locks necessitates the manufacture of separate lock components for right hand hinges from those used for left hand hinges.

SUMMARY OF THE INVENTION

Accordingly, the present invention seeks to at least partially overcome the disadvantages of prior art devices by providing a window lock which includes a reciprocally movable tie bar having one or more camming members thereon, and which are selectively moved into and out of engagement with keeper members by means of a lockable handle lever.

Another object of the invention is to provide a lock which may be used to secure any of a variety of different window sashes closed against different designs of window frames.

A further object of the invention is to provide a window lock actuating mechanism which is adapted for use in either a right hand or left hand configuration.

Another object of the invention is to provide a window lock which includes an operating mechanism having a construction which permits simplified assembly and manufacture.

Another object of the invention is to provide a multi-point window sash lock having an operating handle which may be locked in an unlocked and/or locked position.

The present invention provides for a locking mechanism which may be used to secure any number of window sashes closed against a window frame. The lock includes at least one and preferably two or more keepers mounted to the window sash, a tie bar having thereon a number of rollers or camming members corresponding to that of the keepers, and an actuator assembly. The actuator assembly and tie bar are mounted to the window frame, with the actuator assembly configured to reciprocally move the tie bar along its axis to selectively move each roller into and out of engagement with a corresponding associated keeper.

The actuator assembly includes a housing or base which is secured to the window frame, and an actuator arm which is elongated in a longitudinal direction between distal and proximal ends and handle lever which are each pivotally mounted to the housing for movement between two limit positions. The distal end of the actuator arm extends from the housing towards the window sash to engage either the tie bar or a linkage arm coupled to the tie bar. A camming pin is coupled to the handle lever for rotation therewith as the handle lever is moved between its limit positions. The camming pin is configured so as to be received in a slot formed towards a proximal end of the actuator arm remote from the tie bar. With this configuration, the rotation of the handle lever rotates the camming pin along an arc of a circle centered on the handle pivot. As the camming pin moves along its arcuate path, its engagement with the sides of the slot biases the actuator arm in pivotal movement. The result is that the distal end of the actuator arm is moved along an arcuate path centered on the arm pivot, and which in turn urges the tie bar in movement to slide the rollers into or out of contact with the keepers.

Preferably, on moving between its limit positions, the actuator arm rotates about a pivot axis which is intermediate the distal and proximal ends, and which is spaced from the pivot axis of the handle and camming pin. In this configuration, the rotation of the camming pin with the handle results in its relative movement longitudinally in the slot. More preferably, the window lock includes a locking mechanism used to lock the handle in either, and preferably both, fully unlocked limit position and fully locked limit position. In one simplified construction, the locking mechanism is provided with the actuator arm and, for example, could include resiliently deformable ribs, tabs, shoulders or other projections used to restrict the longitudinal movement of the camming pin in the slot. By restricting the movement of the camming pin relative to the actuator arm, the handle lever is thus also prevented from rotating, locking the handle in place. In one construction, the actuator arm slot is formed in part of an insert made from a plastic, nylon, or other resiliently deformable material. The insert is coupled to the remainder of the actuator arm which, for increased wear, is preferably fashioned from steel, hardened plastic or other such rigid materials.

In a simplified configuration, a second slot is formed in the distal end of the actuator arm. A bearing pin mounted to the tie bar may be thus slidably received in the second slot. The pivotal movement of the distal end of the actuator arm as it moves along its arcuate path results in the engagement with the bearing pin to slide the tie bar. Alternately, the actuator arm may be directly or indirectly coupled to the tie bar by a permanent pivot or a releasable locking pivot such as that disclosed in the applicant's co-pending Canadian Patent Application No. 2,197,842, filed Feb. 18, 1997.

More preferably, the handle pivot is spaced from the arm pivot towards the proximal end, with the proximal end slot extending to the proximal end of the actuator arm. This configuration advantageously permits the simplified manufacture of the actuator assembly by enabling the actuator arm to be slid into the housing so that the camming pin locates in the endmost portion of the slot. Once the actuator arm is so positioned, a pin may be inserted through the housing and actuator arm as the arm pivot, to permanently couple the actuator arm and housing.

Accordingly, in one aspect the present invention resides in a window lock for securing a window sash closed against a window frame, comprising, a keeper member secured to said sash, an axially elongated tie bar mounted to the window frame, said tie bar having a roller member thereon and being reciprocally movable along its axis to selectively move said roller member into or out of engagement with said keeper member, a base mounted to said window frame, an elongated actuator arm having opposed first and second ends and a first end slot formed in said first end, said actuator arm pivotally mounted to said base at a first pivot spaced intermediate said first and second ends, a handle member pivotally mounted to said base at a second pivot, a camming pin extending into said first end slot and being coupled to said handle at a position spaced from said second pivot, said camming pin being movable together with said handle along an arcuate path, whereby the movement of the camming pin along said arcuate path moves the camming pin relative to the first end and urges the second end of the actuator arm in pivotal movement about the first pivot.

In another aspect, the present invention resides in a multi-point window lock for securing a window sash closed against a window frame, comprising, a plurality of keeper members secured to said window sash, an axially elongated tie bar mounted to the window frame, said tie bar having a plurality of roller members thereon, each of said roller members being axially spaced along said tie bar and associated with one of said plurality of keeper members, said tie bar being reciprocally movable along its axis to selectively move each roller member into or out of engagement with its associated keeper member, a base mounted to said window frame, an actuator arm being longitudinally elongated between opposed first and second ends and pivotally mounted to said base at a first pivot intermediate said first and second ends, the actuator arm including a longitudinally extending first end slot formed towards said first end, and the second end being linked to the tie bar for movement therewith, a handle member pivotally mounted to said base at a second pivot, a camming pin extending into said first slot, the camming pin being coupled to said handle and movable together with said handle along an arcuate path spaced from said second pivot, whereby the pivotal movement of the handle member moves the camming pin along said arcuate path and longitudinally relative said first end slot to pivot the second end of the camming arm about the first pivot.

BRIEF DESCRIPTION OF THE DRAWINGS

Further objects and advantages of the invention will appear from the following description taken together with the accompanying drawings in which.

DETAILED DESCRIPTION OF THE PREFERRED EMBODIMENT

Figure 1:
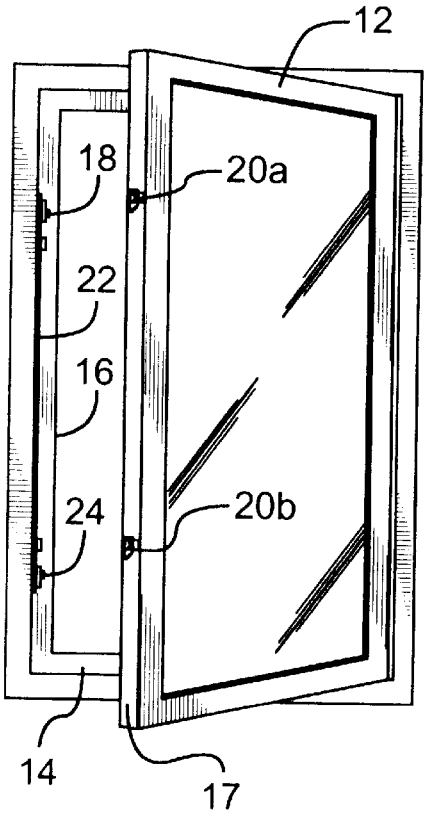
FIG. 1 shows a perspective view of an open window showing the mounting of a window lock thereon in accordance with a preferred embodiment of the invention.

FIG. 1 shows a casement-type window 10 with a window sash 12 open relative to a window frame 14 in an unlocked position. The window sash 12 is pivotally mounted to the frame at a hinged vertical edge by hinges (not shown), and includes a window lock 16 which is selectably operable to secure a locking edge 17 and permit or prevent the window 10 to be opened. The locking edge 17 of the window sash 12 includes parallel external and internal vertical walls joined by a vertical end plane. In moving the sash 12 to the closed position, the vertical end plane is brought into juxtaposition with an opposing vertical frame wall 18.

Figure 2:
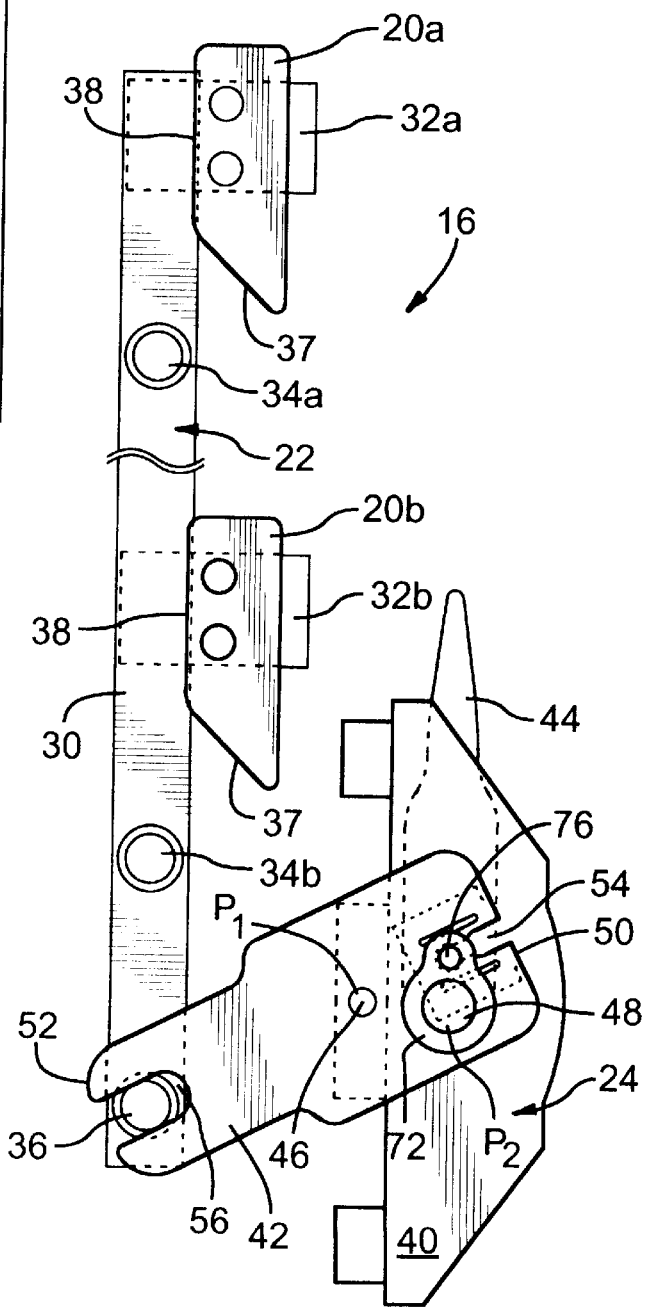
FIG. 2 is a schematic side view of a window lock for use on the window shown in FIG. 1 in a fully unlocked configuration.
Figure 3:
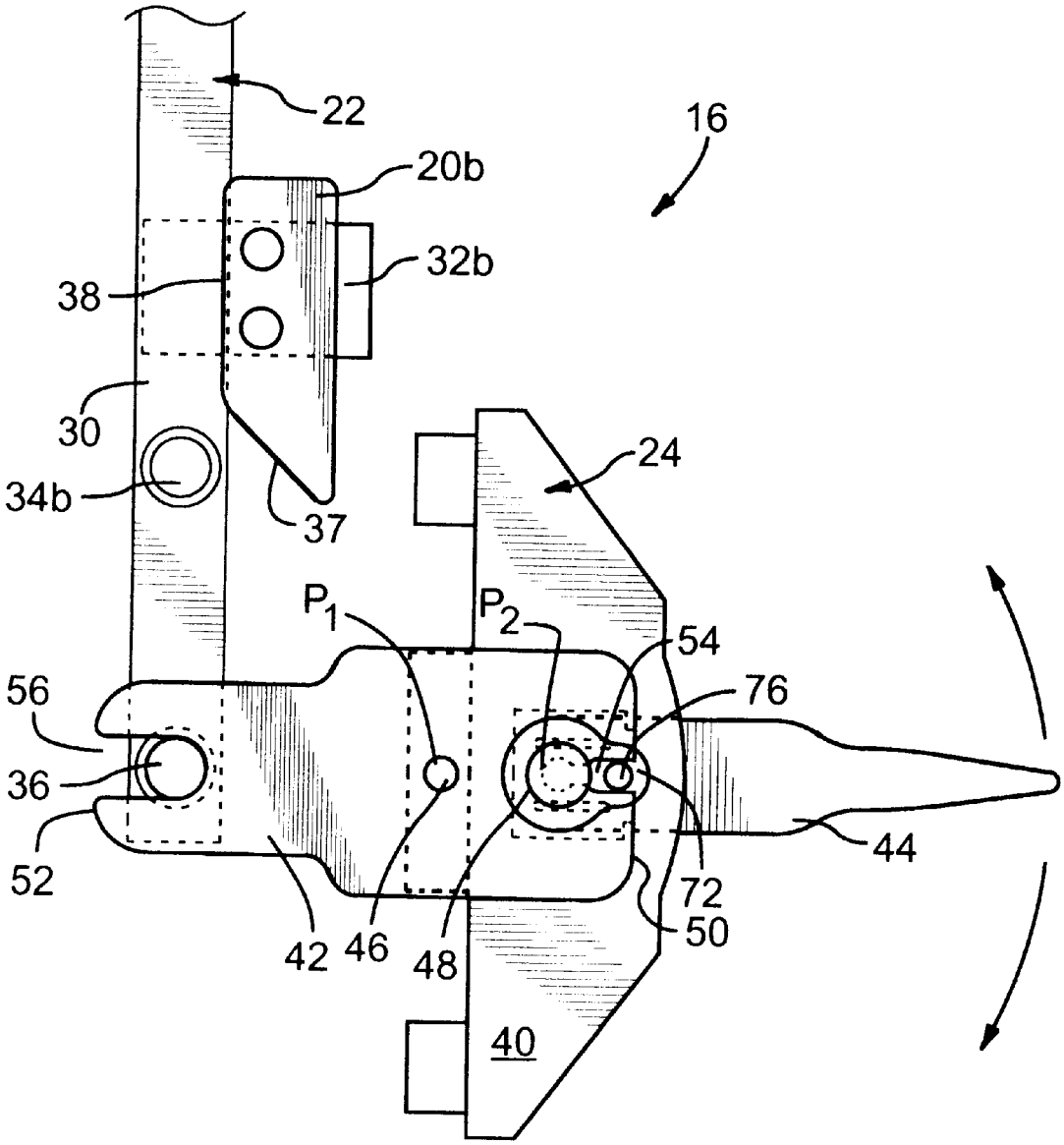
FIG. 3 is an enlarged partial schematic side view of the window lock shown in FIG. 2 with the locking handle moved half way between a fully locked and a fully unlocked configuration.
Figure 4:
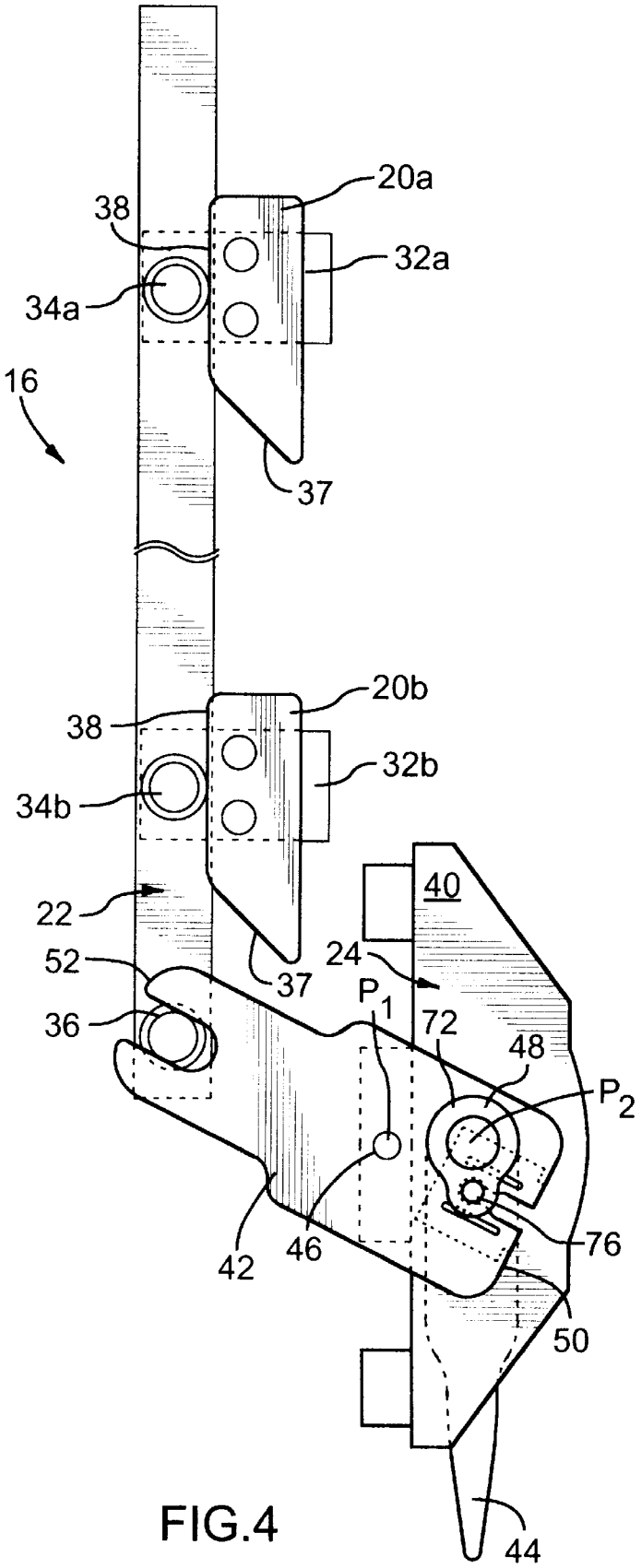
FIG. 4 is a schematic side view of the window lock of FIG. 2 moved to a fully locked position.

FIGS. 2 to 4 show best the interaction of the various window lock 16 components as the lock 16 is moved between a fully unlocked configuration shown in FIG. 2 and a fully locked configuration shown in FIG. 4. In the embodiment shown, the window lock 16 consists of two vertically spaced ramped keeper members 20*a,* 20*b,* a tie bar assembly 22 and an actuating assembly 24. As shown best in FIG. 1, the ramped keepers 20*a,*20*b* are secured to the locking edge 17 of the window sash 12 by screws so as to locate vertically above one another.

FIG. 2 shows the tie bar assembly 22 as including a tie bar or slider 30, mounting brackets 32*a,*32*b,* two camming rollers 34*a,*34*b* and a bearing stud 36. The bearing stud 36 is shown fixedly mounted to one end of the tie bar or slider 30, although positioning elsewhere is equally possible. The slider 30 is formed as an elongated bar and is movably retained by the mounting brackets 32*a,* 32*b* on the frame wall 18 (FIG. 1). The brackets 32*a,* 32*b* mount the slider 30 so as to permit reciprocal movement of the slider 30 in the vertical direction. The camming rollers 34*a,* 34*b* are mounted on the slider 30 and project outwardly from the vertical frame wall 18. The rollers 34*a,* 34*b* are positioned so that when the window sash 12 is fully closed, the reciprocal movement of the slider 30 in the vertical direction moves each roller 34*a,* 34*b* either into or out of engagement with an associated keeper member 20*a,* 20*b,* respectively.

The reciprocal movement of the slider 30 thus achieves either the unlocking of the window 10 when the rollers 34*a,* 34*b* are lowered out of engagement with the keeper members 20*a,*20*b* as shown in FIG. 2, or the locking of the window 10 as shown in FIG. 4 when the rollers 34*a,*34*b* are moved upwardly on the slider 30 to engage the keeper members 20*a,*20*b.* As shown in FIGS. 2 to 4, each ramped keeper 20 has an inclined ramped section 37 and a generally planar section 38. When the window sash 12 is fully closed and the slider 30 is slid to the locking position in FIG. 4, each roller 34 moves upwardly to engage the ramp section 37 of its associated keeper 20, to pull the window 10 fully closed as it moves against the planar section 38. The downward movement of the slider 30 conversely moves the cam rollers 34*a*,34*b* downwardly clear of the keeper members 20*a*, 20*b* completely to unlock the window 10.

FIGS. 2 to 7 show the actuating assembly 24 used to reciprocally move the slider 30 and either lock or unlock the window sash 12 from the frame 14. The actuating assembly 24 includes a base or housing 40 which is mounted to the window frame 14, an actuator arm 42 and a handle 44. Both the actuator arm 42 and handle 44 are pivotally coupled to the housing 40 at a respective spaced apart arm pivot 46 and handle pivot 48. As will be described hereafter, the handle 44 and actuator arm 42 may be each reciprocally moved between two limit positions shown in FIGS. 2 and 4 to either unlock (FIG. 2) or lock (FIG. 4) the window 10.

FIGS. 2 to 6 show the actuator arm 42 best as being generally elongated in a longitudinal direction extending from a proximal end 50 which is received in the housing 40, to a distal end 52 which engages the bearing stud 36. The actuator arm 42 is coupled with its proximal end 50 received in the housing 40 by a cylindrical steel pin which functions as the arm pivot 46. The pin is inserted through a complementary sized bore 47 (FIG. 5) which is formed through the longitudinal center of arm 42 so as to locate intermediate the handle pivot 48 and distal end 52. In this manner each end 50,52 of the actuator arm 42 is movable along an arcuate path about a pivot axis $P_1$ located at the axial center of the arm pivot 46. A pair of aligned longitudinally extending slots 54,56 are formed in each end 50,52 of the actuator arm 42. Although not essential, the slots 54,56 preferably are positioned on the longitudinal center of the actuator arm 42, aligned with each other and the arm pivot 46. The slot 56 formed in the distal end 52 is sized to slidably receive the bearing stud 36 therein and permit limited movement of the actuator arm 42 relative to the slider 30. In particular, FIGS. 2 to 4 show best that as the actuator arm 42 rotates about the arm pivot 46 and the distal end 52 moves along its arcuate path centered on the pivot axis $P_1$, the engagement of the arm 42 against the bearing stud 36 moves the slider 30 vertically and the stud 36 longitudinally relative to the slot.

Figure 5:
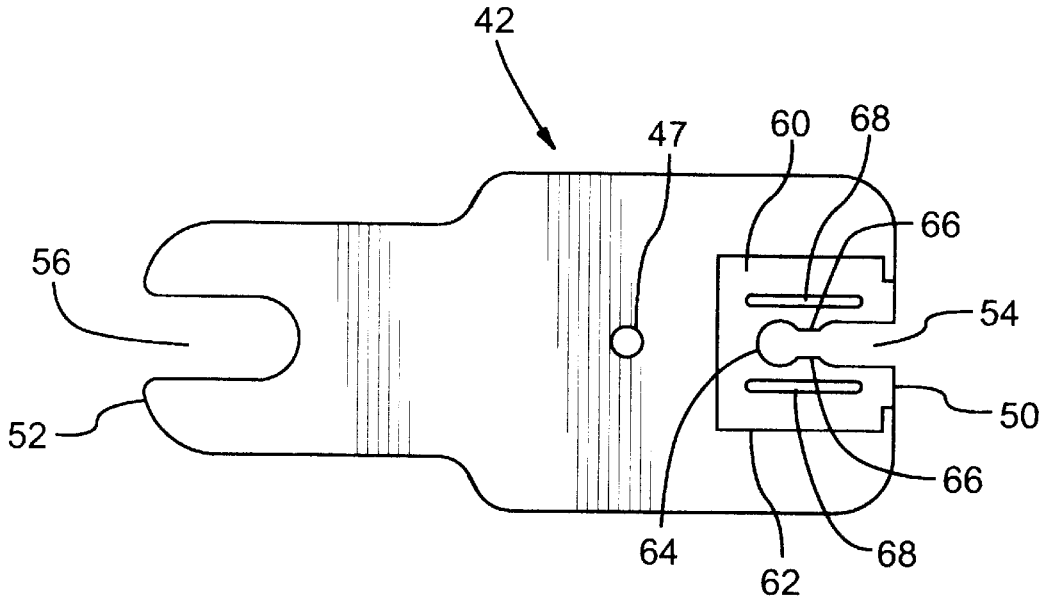
FIG. 5 is a perspective view of an actuator arm used in the window lock of FIG. 1.
Figure 6:
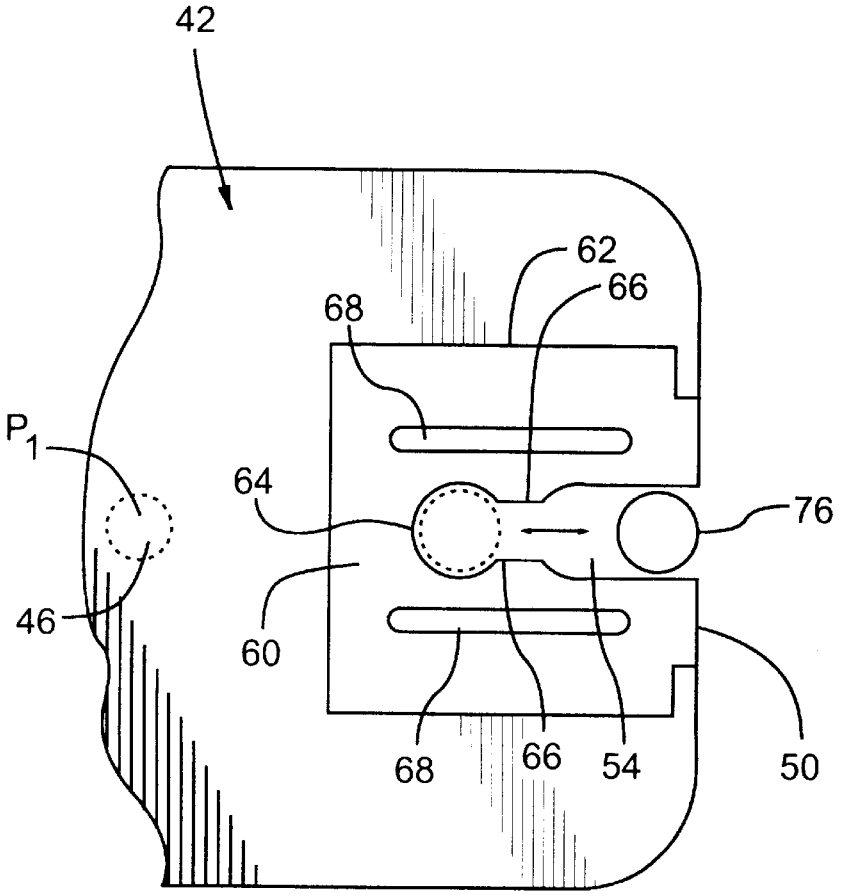
FIG. 6 shows an enlarged perspective view of the actuator arm locking slot and camming pin shown in FIG. 3.

FIGS. 5 and 6 show best the slot 54 in the housed proximal end 50 of the actuator arm 42 as being defined by a plastic insert 60. The insert 60 is fitted within a complementary sized cut-out 62 so as to be securely retained by a remaining portion of the arm 42, which may be formed from a rigid material such as steel, aluminum or other metals. The slot 54 extends inwardly from the end 50 of the actuator arm 42 to an innermost bight 64. The slot 54 further defines a pair of inwardly pinching shoulders 66 which locate a marginal distance from the bight 64. As will be described hereafter, the shoulders 66 are used to lock the handle 44 in both a fully locked and fully unlocked position. A pair of through apertures 68 are formed through the insert 60 adjacent each shoulder 66. The through apertures 68 are sized to weaken the rigidity of the insert 60 and permit the shoulders 66 to resiliently and elastically deform apart.

Figure 7:
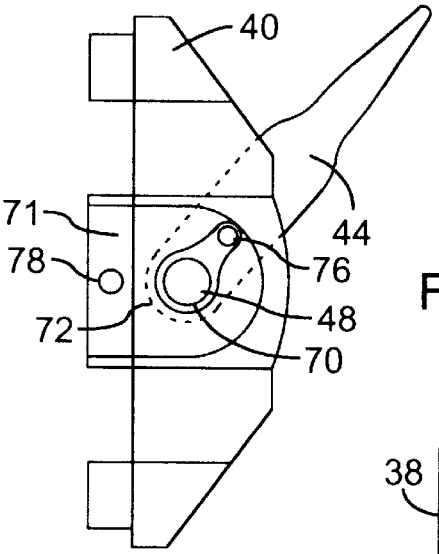
FIG. 7 shows a cut-away perspective view of the housing, camming pin and handle lever used in the locking mechanism of FIG. 1.

FIG. 7 shows best a partial cut-away view of the mounting of the handle 44 to the housing 40. The handle 44 has integrally formed at one end a cylindrical shaft which functions as the pivot 48. The shaft is inserted through a bore 70 formed in a side of the housing 40 a distance from the arm pivot 46, so as to extend into a U-shaped cavity 71. The pivot 48 is rotatably retained in the cavity 71 by a retaining ring 72 which is secured to the pivot 48 for rotation therewith. The pivot 48 extends only partway into the cavity 71 so as not to interfere with the movement of the actuator arm 42 about its pivot axis $P_1$. When so coupled, the handle 44 is rotatable about a pivot axis $P_2$ which is centered on the pivot 48 and substantially parallel to pivot axis $P_1$. The result is that the handle 44 is pivotable about the pivot axis $P_2$ which is spaced from the pivot axis $P_1$. The ring 72 may be coupled to the pivot 48 in a number of ways including by welding, or by the use of mechanical fasteners (not shown) such as the use of nuts, pins, or crimp washers.

A camming pin 76 is fixedly mounted to a peripheral edge of the retaining ring 72 spaced radially from the pivot axis $P_2$. The camming pin 76 extends in the direction of the pivot axis $P_2$. The camming pin 76 has a radial diameter marginally greater than the distance separating the shoulders 66 and is sized and configured to locate within the proximal end slot 54. By attaching the ring 72 and camming pin 76 to the handle pivot 48, the handle 44 is permanently secured to the housing 40 against removal.

The rotation of the handle 44 thus moves the camming pin 76 along a semi-circular arcuate path centered on the pivot axis $P_2$. The camming pin is spaced a radial distance from the arm pivot 46 with the result that the movement of the handle 44 between the positions shown in FIGS. 2 and 4 moves the camming pin 76 both along its arcuate path and longitudinally relative to the slot 54 past the shoulders 66.

FIGS. 2 to 4 show best the movement of the camming pin 76 in biasing the actuator arm 42 in pivotal movement between its two limit positions. As the handle 44 is moved upwardly to the fully unlocked position shown in FIG. 2, the camming pin 76 rotates counter-clockwise with the handle 44 about the pivot axis $P_2$, so that it is positioned directly vertically above the pivot 48. As the camming pin 76 rotates to its uppermost position shown in FIG. 2, its engagement with the sides of the slot 54 results in the downward pivoting of the distal end 52 of the actuator arm 42 about the pivot axis $P_1$. The downward movement of the exposed distal end 52 thus engages stud 36 and moves the slide 30 to a fully lowered position, with the rollers 34*a*,34*b* moved out of contact from the keeper members 20*a*,20*b* to permit window opening. Simultaneously as the camming pin 76 rotates, it moves longitudinally relative to the slot 54 to a position seated directly against the bight 64. The engagement of the camming pin 76 with the bight 64 thereby limits further rotational movement of both the handle 44 and actuator arm 42 past the fully unlocked position. In addition, as the pin 76 moves inwardly relative to the slot 54, it initially contacts and biases the shoulders 66 apart. Once the pin 76 moves inwardly past the shoulders 66 to the position shown in phantom in FIG. 6, the resiliency of the plastic material causes the shoulders 66 to return to their undeformed position, preventing the free withdrawal of the camming pin 76 outwardly. The shoulders 66 thus act to lock the camming pin 76 against the bight 64. It is to be appreciated, that locking the camming pin 76 against longitudinal movement effectively prevents rotation of the handle 44 about the pivot axis $P_2$, and achieved locking of the handle 44 in a fully unlocked limit position.

To lock the window 10, the handle 44 is pulled with a sufficient minimum force to urge the camming pin 76 again against the shoulders 66 causing them to deform outwardly and permit the movement of the pin 76 therepast. As the handle 44 is pivoted downwardly, the camming pin 76 rotates clockwise about the pivot axis $P_2$. This results in the pin 76 initially moving away from the bight 64 to the position shown in FIG. 3 when the handle 44 is at the half-way point between the fully locked and fully unlocked positions, and where the camming pin 76 is furthest from the bight 64. As the camming pin 76 continues to rotate clockwise with the handle 44 downwardly about the pivot axis $P_2$ to the position shown in FIG. 4, and the pin 76 positions vertically beneath the pivot 48, the pin 76 again moves inwardly relative to the longitudinal length of the slot 54. As the camming pin 76 returns towards the bight 64, it again biases the shoulders 66 outwardly as it moves to the seated position locked in place against the bight 64. The positioning of the camming pin 76 against the bight 64 limits further movement of the handle 44 and actuator arm past the fully locked position. The downward rotation of the camming pin 76 and its engagement with the slot 54 causes the exposed distal end 52 of the camming arm 42 to move upwardly along an arcuate path centered on the pivot axis $P_1$ to raise the slider 30 moving the rollers 34*a*,34*b* to the locked position engaging the keeper members 20*a*,20*b*. As such, when the handle 44 is moved to either of the fully unlocked limit position or the fully unlocked limit position, the handle 44 is locked in place by the engagement of the shoulders 66 against the pin 76.

The construction of the actuating assembly 24 permits its use in either a right or left hand position. In addition to permitting either right or left hand use of the actuating assembly 24, the construction of the window lock 16 provides a further advantage in that it permits simplified manufacture. To assemble the actuating assembly 24, the handle 44 is coupled to the housing 40 by the ring 72. The actuator arm 42 is then inserted into the housing 40 to locate the camming pin 76 in the open end of the slot 54. This is preferably done when the handle 44 is in the intermediate position shown in FIG. 3. To permanently couple the actuator arm 42 to the housing 40, a steel cylindrical post is then inserted through aligned apertures 78 (FIG. 7) formed in the housing 40 and arm 42 to preventing its withdrawal from the housing 40.

Figure 8:
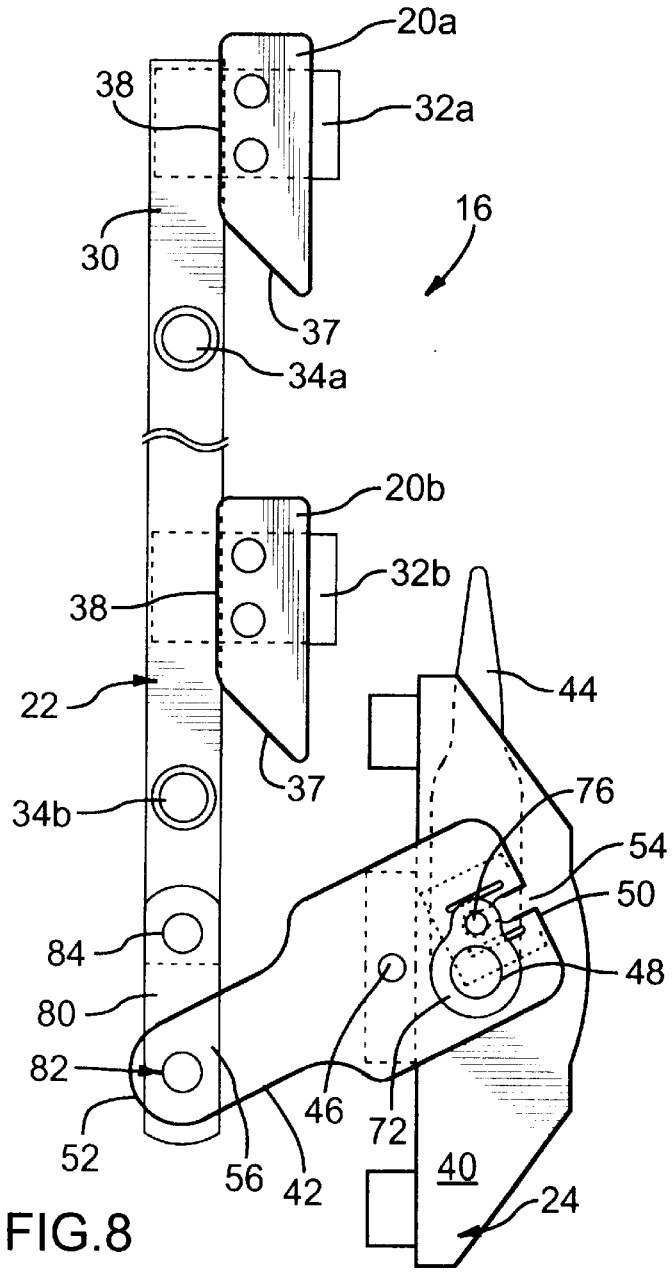
FIG. 8 shows a schematic side view of a window lock in accordance with a second embodiment of the invention in a fully unlocked configuration.
Figure 9:
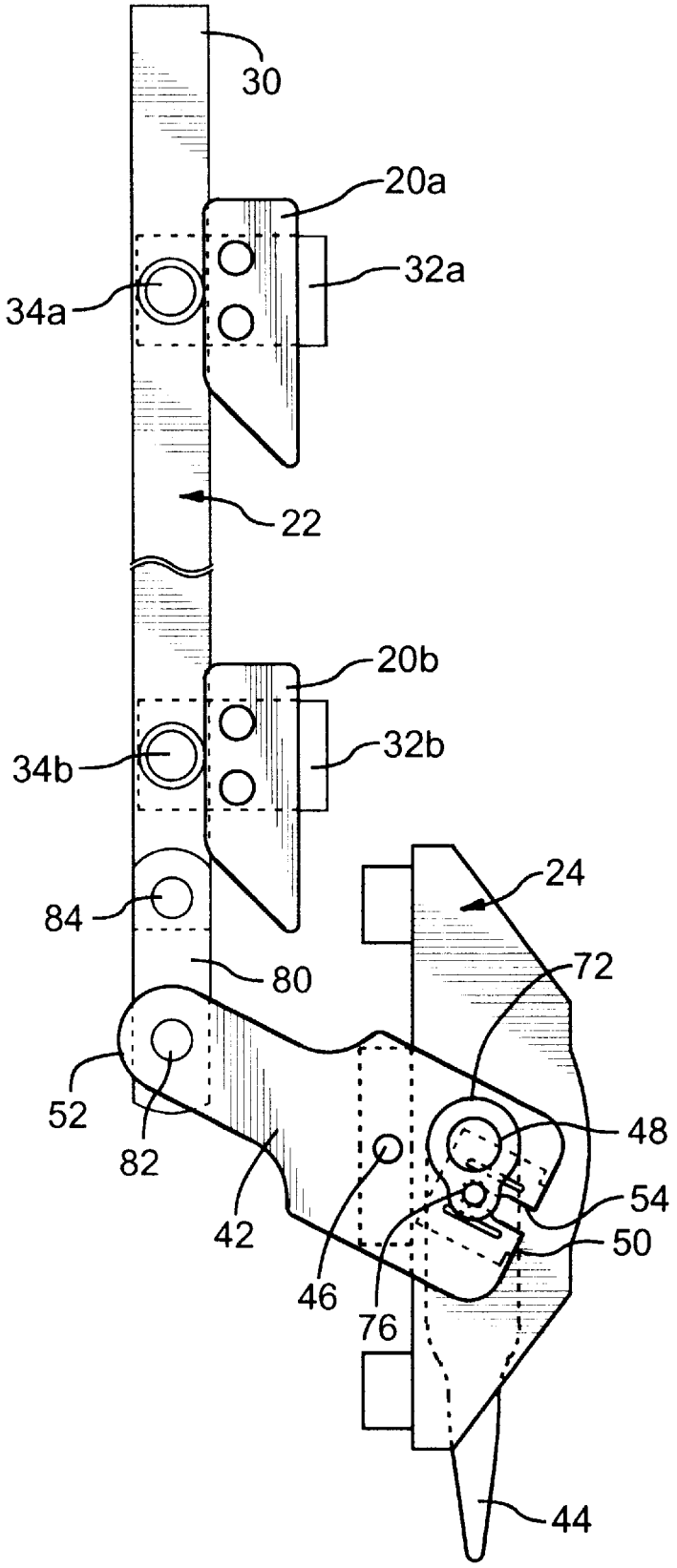
FIG. 9 shows a schematic side view of the window lock of FIG. 8 moved to a fully locked configuration.

Although the preferred embodiment of the invention shown in FIGS. 2 to 7 discloses the slidable coupling of the distal end 52 of the actuator arm 42 with the bearing stud 36, other means of coupling the actuator arm 42 to the slider 30 will now become apparent. FIGS. 8 and 9 show a further embodiment of a lock 16 in accordance with the invention, wherein like reference numerals are used to identify like components. In FIGS. 8 and 9, the distal end 52 of the actuator arm 42 is pivotally coupled to a hinged linkage arm 80 by a cylindrical pivot 82. The other end of the linkage arm 80 which is remote from the actuator arm 42 is in turn coupled by a releasable locking pivot 84 to the bottom of the slider 30.

With the construction shown in FIGS. 8 and 9, as the handle 44 is used to move the actuator arm 42 between the fully unlocked position shown in FIG. 8 and the locked position shown in FIG. 9, the distal end 52 travels along its arcuate path centered on the arm pivot 46. As the distal end 52 initially moves, the linkage arm 80 flexes about the pivots 82,84 so that its bottom end swings outwardly from a position vertically aligned beneath the releasable pivot 84 to an offset position moved away from the housing 40, when the handle 44 locates half-way between the fully locked and unlocked positions. As the handle 44 continues to move to the fully locked position, the hinged end of the linkage arm 80 swings back into vertical alignment with the release pivot 84 to the position shown in FIG. 9.

Although the detailed description of the invention describes the use of the window lock 16 with a casement type window 10, it is to be appreciated that the lock 16 is equally suitable for numerous different window types including awning-type windows, double hung windows and other window types which are configured for either pivotal or horizontal movement.

Although the detail description of the invention describes the locking mechanism as consisting of a pair of elastically deformable shoulders 66 extending towards each other in the slot 54, the invention is not so limited. If desired, other means of locking the camming pin 76 relative to the slot 54 are also possible and will now become readily apparent. By way of non-limiting examples, the camming pin 76 could also be retained against relative movement in the slot 54 by the use of plastic or metal clip members, ribs, or flanges. Although the use of a plastic insert 60 in the actuator arm 42 provides a simplified resiliently deformable structure, in an alternate construction the camming pin 76 could be made of elastically deformable material without departing from the scope of the present invention.

While the detailed description of the invention discloses the use of the locking mechanism with a vertically movable tie bar 30, and wherein the handle 44 is pivoted between a vertically raised and lowered position, the invention is not so limited. The window lock 16 of the present invention may equally be used in a horizontal configuration where the handle lever is moved in the right or left direction relative to an operator.

Although the detailed description discloses the window lock as including a pair of rollers 34 and ramped keepers 20, the invention is not so limited. If desired, the window mechanism could incorporate only a single cam roller and keeper member. Alternately, three, four or even more rollers and corresponding keeper members could be provided depending upon the size and configuration of the window construction.

Although the detailed description describes various preferred embodiments, the invention is not so limited. Many modifications and variations will now occur to a person skilled in the art. For a definition of the invention, reference may be had to the appended claims.

We claim:

1. A window lock for securing a window sash closed against a window frame, comprising, a keeper member for mounting to said sash, an axially elongated tie bar for mounting to the window frame, said tie bar having a roller member thereon and being reciprocally movable along its axis to selectively move said roller member into or out of engagement with said keeper member, a base for mounting to said window frame, an elongated actuator arm having opposed first and second ends and a first end slot formed in said first end, said actuator arm pivotally mounted to said base at a first pivot spaced intermediate said first and second ends, a handle member pivotally mounted to said base at a second pivot, a camming pin extending into said first end slot and being coupled to said handle at a position spaced from said second pivot, said camming pin being movable together with said handle along an arcuate path, whereby the movement of the camming pin along said arcuate path moves the camming pin relative to the first end slot and urges the second end of the actuator arm in pivotal movement about the first pivot, the window lock further comprising a locking mechanism operable to releasably retain the camming pin against longitudinal movement relative said first end slot and maintain the handle member in a locked position.

2. A window lock as claimed in claim 1 wherein the locking mechanism comprises at least one resiliently deformable shoulder member movable between an unbiased position extending at least part way across said first end slot to substantially prevent relative longitudinal movement of the camming pin therepast, and a biased position enabling longitudinal movement of the camming pin in the slot.

3. A window lock as claimed in claim 1 wherein the second end of the actuator arm includes a second end slot formed in said second end, and the tie bar further includes a bearing member extending into the second end slot wherein the engagement of the actuator arm with the bearing member urges the tie bar in reciprocal movement.

4. A window lock as claimed in claim 1 wherein said second pivot is spaced intermediate said first pivot and said first end.

5. A window lock as claimed in claim 2 wherein said second pivot is spaced from said first pivot.

6. A window lock as claimed in claim 2 wherein said first end slot includes a bight spaced towards said first pivot, and when said handle is in said locked position said at least one shoulder member retains said camming pin in a position adjacent said bight.

7. A window lock as claimed in claim 1 wherein said first pivot is for positioning adjacent said window sash when said sash is closed against said frame.

8. A window lock as claimed in claim 4 wherein said arcuate path comprises a substantially semi-circular path centered on said second pivot.

9. A window lock as claimed in claim 1 wherein the lock further includes a linkage member having first and second ends, the second end of the actuator arm being pivotally coupled to the first end of the linkage member, and the second end of said linkage member being pivotally coupled to the tie bar.

10. A multi-point window lock for securing a window sash closed against a window frame, comprising, a plurality of keeper members for attachment to said window sash, an axially elongated tie bar for mounting to the window frame, said tie bar having a plurality of roller members thereon, each of said roller members being axially spaced along said tie bar and associated with one of said plurality of keeper members, said tie bar being reciprocally movable along its axis to selectively move each roller member into or out of engagement with its associated keeper member, a base for mounting to said window frame, an actuator arm being longitudinally elongated between opposed first and second ends and pivotally mounted to said base at a first pivot intermediate said first and second ends, the actuator arm including a longitudinally extending first end slot formed towards said first end, and the second end being linked to the tie bar for movement therewith, a handle member pivotally mounted to said base at a second pivot, a camming pin extending into said first end slot, the camming pin being coupled to said handle and movable together with said handle along an arcuate path spaced from said second pivot, a locking mechanism to releasably retain the camming pin against longitudinal movement relative said first end slot and maintain the handle member in a locked position, whereby the pivotal movement of the handle member moves the camming pin along said arcuate path and longitudinally relative said first end slot to pivot the second end of the camming arm about the first pivot.

11. A window lock as claimed in claim 10 wherein the locking mechanism comprises at least one resiliently deformable shoulder member movable between an unbiased position extending at least part way across said first end slot to substantially prevent relative longitudinal movement of the camming pin therepast, and a biased position enabling longitudinal movement of the camming pin in the slot.

12. A window lock as claimed in claim 11 wherein the second end of the actuator arm includes a longitudinally extending second end slot formed towards the second end, and the tie bar further includes a bearing member extending into the second end slot, wherein the engagement of the actuator arm with the bearing member urges the tie bar in reciprocal movement.

13. A window lock as claimed in claim 11 wherein said second pivot is spaced intermediate said first pivot and said first end.

14. A window lock as claimed in claim 10 wherein said second pivot is spaced from said first pivot.

15. A window lock as claimed in claim 11 wherein said first end slot includes a bight spaced towards said first pivot, and when said handle is in said locked position said at least one shoulder member retains said camming pin in a position adjacent said bight.

16. A window lock as claimed in claim 10 wherein the lock further includes a linkage member having first and second ends, the second end of the actuator arm being pivotally coupled to the first end of the linkage member, and the second end of said linkage member being pivotally coupled to the tie bar.

17. A window lock for securing a window sash closed against a window frame, comprising, a keeper member for mounting to said sash, an axially elongated tie bar for mounting to the window frame, said tie bar being reciprocally movable along its axis to selectively move into or out of engagement with said keeper member, a base for mounting to said window frame, an elongated actuator arm having opposed first and second ends and a first end slot formed in said first end, said actuator arm pivotally mounted to said base at a first pivot spaced intermediate said first and second ends, a handle member pivotally mounted to said base at a second pivot spaced intermediate said first pivot and said first end, a camming pin extending into said first end slot and being coupled to said handle at a position spaced from said second pivot, said camming pin being movable together with said handle along an arcuate path, whereby the movement of the camming pin along said arcuate path moves the camming pin relative to the first end slot and urges the second end of the actuator arm in pivotal movement about the first pivot.

18. A window lock as claimed in claim 17 wherein the actuator arm includes a locking mechanism to releasably retain the camming pin against movement and maintain the handle in a locked position, the locking mechanism comprising a resiliently deformable shoulder member movable between an unbiased position extending at least part way across said first end slot to substantially prevent relative movement of the camming pin therepast, and a biased position wherein said shoulder member is moved to a position enabling movement of the camming pin therepast.

19. A window lock as claimed in claim 18 wherein said first end slot includes a bight spaced towards said first pivot, wherein when said handle is in said locked position said at least one shoulder member retains said camming pin in a position adjacent said bight.

20. A window lock as claimed in claim 17 wherein said arcuate path comprises a substantially semi-circular path centered on said second pivot.

* * * * *